US008511843B2

(12) United States Patent
Hofmann et al.

(10) Patent No.: US 8,511,843 B2
(45) Date of Patent: Aug. 20, 2013

(54) ORGANIC ILLUMINATION DEVICE AND LIGHTING DEVICE

(75) Inventors: Michael Hofmann, Dresden (DE); Christian Mogel, Dresden (DE); Torsten Coym, Dresden (DE); Sebastian Wolfram, Dresden (DE)

(73) Assignee: Novaled AG, Dresden (DE)

( * ) Notice: Subject to any disclaimer, the term of this patent is extended or adjusted under 35 U.S.C. 154(b) by 336 days.

(21) Appl. No.: 12/879,559

(22) Filed: Sep. 10, 2010

(65) Prior Publication Data

US 2012/0039075 A1 Feb. 16, 2012

(30) Foreign Application Priority Data

Aug. 10, 2010 (DE) ..... 20 2010 008 255 U
Aug. 20, 2010 (DE) ..... 20 2010 008 324 U

(51) Int. Cl.
*F21V 9/16* (2006.01)
*F21V 21/30* (2006.01)

(52) U.S. Cl.
USPC ..... 362/84; 362/249.02; 362/287; 362/418

(58) Field of Classification Search
USPC ..... 362/84, 249.02, 249.03, 35, 418, 362/427, 269, 249.1, 285, 287; 313/504
See application file for complete search history.

(56) References Cited

U.S. PATENT DOCUMENTS

| | | | | |
|---|---|---|---|---|
| 4,704,941 | A * | 11/1987 | Reilly | 84/464 A |
| 6,227,687 | B1 * | 5/2001 | Kahwaji | 362/391 |
| 6,565,231 | B1 * | 5/2003 | Cok | 362/653 |
| 6,787,994 | B2 * | 9/2004 | Cok | 313/512 |
| 7,810,948 | B2 * | 10/2010 | Ogashiwa | 362/239 |
| 7,810,985 | B2 * | 10/2010 | Chien | 362/641 |
| 8,256,925 | B2 * | 9/2012 | Yuan | 362/249.07 |
| 8,297,808 | B2 * | 10/2012 | Yuan | 362/428 |
| 8,360,609 | B2 * | 1/2013 | Lee et al. | 362/249.07 |
| 2009/0302729 | A1 * | 12/2009 | Amelung et al. | 313/1 |
| 2010/0157585 | A1 | 6/2010 | Diekmann et al. | |
| 2010/0164411 | A1 * | 7/2010 | Chen et al. | 315/362 |
| 2011/0141737 | A1 * | 6/2011 | Gu et al. | 362/249.1 |
| 2011/0249425 | A1 * | 10/2011 | Aurongzeb et al. | 362/102 |

* cited by examiner

*Primary Examiner* — Peggy A. Neils
(74) *Attorney, Agent, or Firm* — Sutherland Asbill & Brennan LLP

(57) ABSTRACT

This disclosure relates to an organic illumination device that has a light source, a connective device, and a plug device. The light source has a flat illuminating surface containing one or more light-emitting diodes. The connecting device applies electrical power to electrodes and couples one or more organic light-emitting diodes. The plug device, which is electrically connected with the connecting device, is configured for a rotatable mount in such a way that the flat illuminating surface can be swiveled around a rotary axis in a plugged-in position of the plug device.

14 Claims, 6 Drawing Sheets

ORGANIC ILLUMINATION DEVICE AND LIGHTING DEVICE

CROSS-REFERENCE TO RELATED APPLICATIONS

This application hereby claims priority to German Patent Application No. 202010008255.2, filed Aug. 10, 2010, and German Patent Application No. 202010008324.9, filed Aug. 20, 2010, the disclosures of which are expressly incorporated herein by reference in their entirety.

FIELD OF THE INVENTION

The invention concerns an organic illumination device as well as lighting device.

BACKGROUND OF THE INVENTION

Organic illumination devices for generating and emitting light which use organic light-emitting diodes as a light source are known in various designs. The organic diodes are also known as Organic Light-Emitting Diodes (OLED). These are particularly used to construct lighting devices. Designs of organic illuminants are disclosed in document WO 2008/040323 A2.

SUMMARY OF THE INVENTION

The task of the invention is to create an organic illumination device as well as a lighting device for which the mechanical stability and ability to connect it to other equipment are improved during use. Furthermore, the ability to connect the organic illuminant to sources of electrical power shall be optimised to match the power supply.

This task is fulfilled according to the invention by an organic illumination device with a light source which has a flat illuminating surface formed of one or a plurality of organic light-emitting diodes, a connecting device for applying electrical power to electrodes which couples one or more organic light-emitting diodes, and a plug device which is electrically connected with the connecting device and is configured for a mount which is rotatable around a rotary axis in an assigned plug holder in such a way that the flat illuminating surface can be swiveled around the rotary axis in a plugged-in position of the plug device, as well as a lighting device with a basic structure and one or a plurality of plug holders on the basic structure, the respectively one organic illumination device, according to one embodiment herein, being plugged in and rotatable on one or more of the plug holders.

The invention includes the concept of an organic illumination device with the following features:

- a light source which has a flat light-emitting surface formed of one or more organic light-emitting diodes,
- a connecting device which is used to apply an electrical voltage to electrodes which couples the one or more organic light-emitting diodes, and
- a plug device electrically connected with the connecting device and which is configured for a holder pivoting around a rotary axis in an assigned plug holder such that the flat light-emitting surface can be swivelled in a plugged in condition of the plug device around the rotary axis.

Furthermore, a lighting device is created with a basic structure and one or a plurality of plug holders assigned to the basic structure with an organic illumination device of above mentioned design being plugged in rotatably into the one or the plurality of plug holder(s), respectively.

The invention improves connection options for the organic illumination device compared to those currently known for organic illuminants since the rotatable mount on an associated plug holder allows the relative position of the light source to be adjusted relative to the plug holder by rotation and, for example, consideration is given to the space available in which the illumination device is used. Furthermore the direction of light emission can be adjusted by rotating the light source in order to take account of various application situations as regards the illumination of certain areas in the room.

The light source can also easily be removed and mounted again.

The plug device can formed with an earthing contact.

The provided connecting device delivers the electric power, which can be made available via the plug device in its plugged-in condition, to the electrodes of one or more organic light-emitting diodes. In the simplest case this occurs via the electrical cable or line connections. In a further embodiment, the connecting device is fitted with connecting contacts preferably in the form of pins on the plug device, which in turn is connected with the electrodes of the plurality of organic light-emitting diodes, for example also directly. However, the circuit elements can also be integrated into the connecting device, for example for making a specific voltage assembly.

One convenient embodiment of the invention provides a housing being formed in which the connecting device is at least partially accommodated and from which the flat illuminating surface protrudes, the plug device being assigned to the housing. In this embodiment a mechanically stable connection is established via the housing between the light source and the plug connector device. The housing holds the plug device stably on the light source. This improves the utilization properties when used with an organic illumination device.

One preferred further development of the invention provides for the rotational axis being placed parallel to the flat illuminating surface. A preferred further development of the invention provides for the rotational axis being parallel to an illuminating surfaces symmetrical axis.

In one embodiment of the invention the rotational axis lies in the plane of the illuminating surface. In a preferred further development it is possible to provide for the rotational axis and an illuminating surfaces symmetrical axis to essentially coincide.

A convenient embodiment of the invention can provide for the housing to be formed with a slit-shaped mount in which the connecting device is at least partially accommodated. In one variant the slit-shaped mount essentially extends over the whole length of the housing.

An advantageous embodiment of the invention provides for the connecting device being formed with a printed circuit board. With the aid of the printed circuit board it is possible to configure the connecting device in an efficient way, regarding application of different polarities to the electrodes of the organic light-emitting diodes. The printed circuit board can have one or more electronic components mounted on it, for example for the adjustment of the voltage applied to the electrodes. In one embodiment the printed circuit board for the connecting device is formed as extensively overlapping a substrate for the organic light-emitting diode(s). Thus, particularly the mechanical stability of the arrangement with connecting device and the light source will be improved. The connection of the printed circuit board to the electrodes of the one or more organic light-emitting diodes preferably takes place by means of an electrically conductive adhesive. As an alternative or in addition to this it is also possible to use electrically conductive adhesive tape. A copper adhesive band can serve as a basis for soldering.

It may be provided that the printed circuit board is connected with the contacts on the organic light-emitting diodes using mechanical clamps, for example with the aid of spring pins, spring plates or clamps.

Preferably, a further development of the invention provides for the plug device being configured to attach the electrodes to the power supply protected against polarity reversal. The constructive variant of the plug device and the assigned plug holder ensures that these are always connected in the correct way so that any risk of reversal of the poles is excluded.

One advantageous embodiment of the invention can provide that the flat illuminating surface and the plug device are rigidly connected together via the housing. This embodiment differs from known organic illuminants in which, for example, a wire connection exists between the light source and the plug device. Compared to this, the housing provides a rigid connection here between the light source with its flat illuminating surface and the plug device.

One embodiment can provide that the flat illuminating surface is at least partially encompassed by a frame which can, in particular, serve to provide mechanical stabilisation. The frame can be provided for embodiments both with and without a housing, and the frame can be formed integrally with the housing when planning to have both a frame and a housing.

One further development of the invention can provide that the housing is formed of a stretched hollow body form. The housing can be formed of an angular cross-section, for example a quadratic one, or a round or oval cross-section. The stretched housing runs along its longitudinal extent in an embodiment along a rim of the flat illuminating surface of the light source.

A preferred further development of the invention provides for the rotational axis to be formed parallel to a symmetrical axis of the housing. In one embodiment the rotational axis and a symmetrical axis of the housing essentially coincide.

A convenient embodiment of the invention can provide that the flat illuminating surface is at least partially encompassed by a frame. The frame, which is at least formed in sections, particularly contributes to mechanical stabilisation of the light source. In one embodiment the frame for the sections outside the housing of the flat illuminating surface abuts the housing. Therefore, an embodiment in which the housing is formed with a slit-shaped mount can provide that the frame passes through the slit-shaped mount into the housing, thus establishing a mechanical connection between the housing and the frame.

One advantageous embodiment of the invention provides for the plug device being formed with a concentric contact, in particular as a jack plug or a hollow plug.

A further development of the invention can provide for the plug device to be formed with a latching or locking device on the plug side which is configured to interact with an assigned latching or locking device on the socket-side or the plug holder side to fix the flat illuminating surface in a coupled condition of the plug device and plug holder in the various rotating or swivelling positions. This, in the simplest case, can be achieved using friction in that the assigned surfaces are pushed against each other. However, also latching/locking projections and assigned latching/locking seatings which can be optionally done to be form-locking can be formed on the plug device and an assigned plug holder (socket). Alternatively or in addition to this, toothings or profilings such as a spline shaft profiling or a polygon profile can be provided.

One embodiment of the invention provides for the plug device and an associated plug holder being configured so as to block swivelling or rotating of the flat illuminating surface in a first inserted position of the plug device and that it is released in a second inserted position of the plug device, the plug device being able to be moved between the first and the second plugged-in position by means of shift in the assigned plug holder axially to the rotational axis. In the case of an axial shift of position the plug device and the assigned plug holder can be moved towards each other or away from each other without any actual mechanical decoupling taking place, particularly in the last case. The shift can preferably take place by at least 1 mm and not more than 5 mm in a axial direction to the rotational axis. This can be achieved, for example, by means of form-locking connections. Examples of form-locking connections are toothing or a profile such as a spline shaft profiling and a polygon profile.

BRIEF DESCRIPTION OF THE DRAWINGS

The invention is explained below in more detail based on preferred example embodiments while making reference to figures in a drawing. They show.

DESCRIPTION OF PREFERRED EMBODIMENTS OF THE INVENTION

Figure 1:
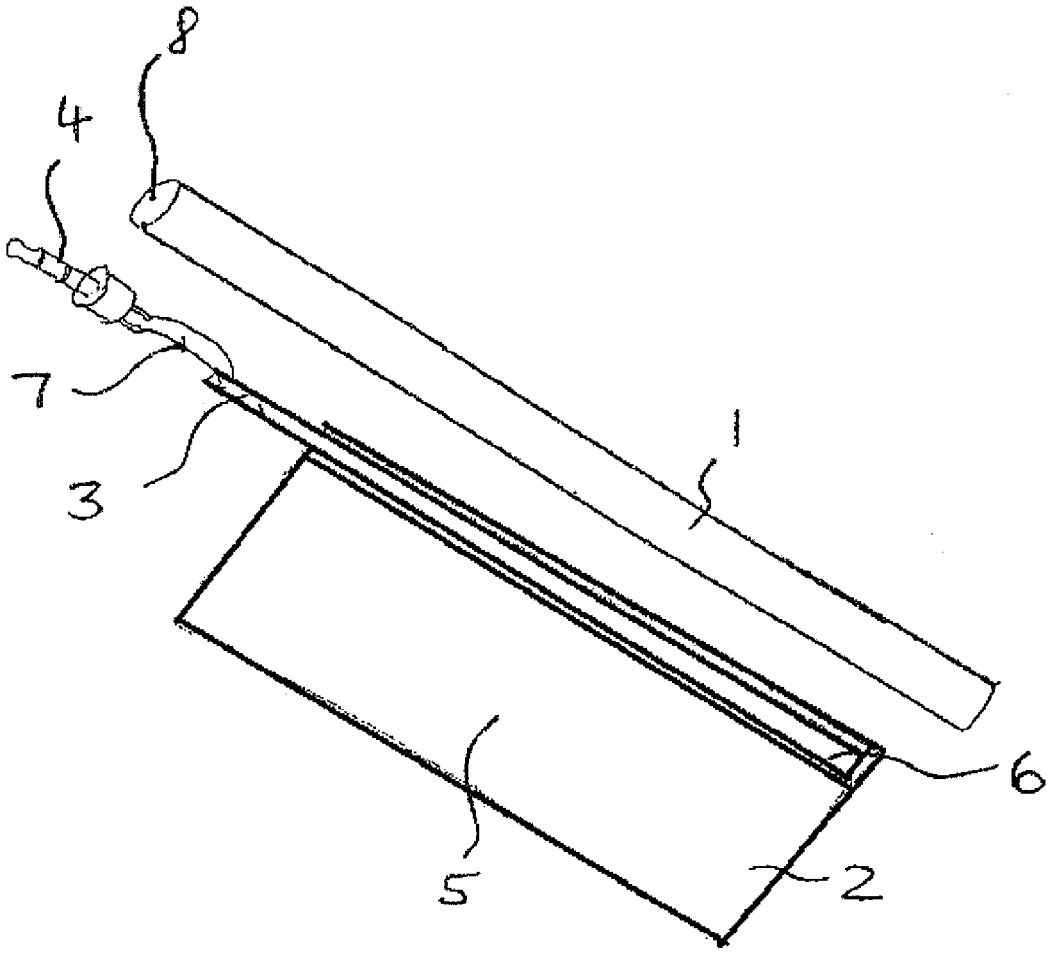
FIG. 1 a schematic diagram of an arrangement for an organic illumination device with a cylindrically formed housing, FIG. 2 a schematic diagram of an organic illumination device according to a further embodiment, FIG. 3 a schematic diagram of an organic illumination device according to a further embodiment and FIG. 4 a lighting device for which a number of organic illumination devices are mounted so that they can be rotated on a basic body structure.

FIG. 1 shows a schematic diagram of a arrangement for an organic illumination device which is formed of a housing 1, a light source 2, a connecting device 3 as well as a plug device 4. The light source 2 has a flat illuminating surface 5 which is formed with the aid of one or more organic light-emitting diodes. Organic light-emitting diodes are known as such in a variety of embodiments. It is possible, with the aid of the different designs of organic light-emitting diodes, to form the flat illuminating surface 5 to emit light on one side or both sides. Also a transparent variant of the flat illuminating surface 5 can be provided for. In one embodiment the fiat illuminating surface 5 is designed to emit white light. Metal plates, glass plates or plastic plates can be used as carrier materials for the organic light-emitting diodes.

The connecting device 3 is located at the side of the flat illuminating surface 5 which is formed with a printed circuit board 6 and serves to apply electrical power to the electrodes of the light-emitting diodes of the light source 2. The connecting device 3 is connected with the plug device 4 via a cable section 7. The plug device 4 is configured to couple the organic illumination device by plugging it into an assigned plug holder (not shown) at a power source such that the organic illumination device in its plugged-in condition can be rotated around the central axis of the plug device 4, the flat illuminating surface 5 being swivelled around the central axis of the plug device 4.

Figure 5:
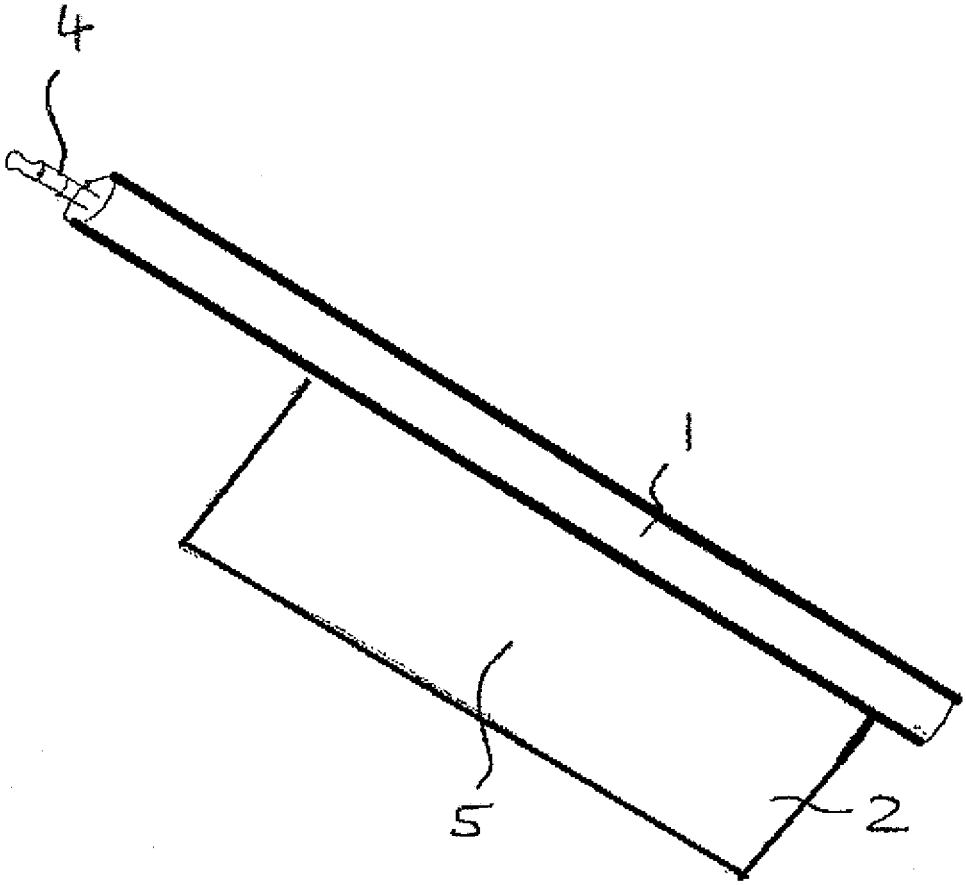
FIG. 5 a schematic diagram of an arrangement for an organic illumination device with a cylindrically formed housing.

To allow better understanding FIG. 1 shows the housing 1 separate from the other elements of the organic illumination device shown. In an assembled condition the connecting device 3 is introduced into the housing through a slit-shaped mount on the housing 1 so that the printed circuit board 6 as well as the cable connection 7 are arranged in the housing 1. The plug device 4 is then introduced on the end face into an opening 8 on the housing 1 and connected rigidly and thinly with this. FIG. 5 depicts the housing in this position. In this way a mechanically fixed connection is created between the light source 2, the housing 1 as well as the plug device 4. The plug device 4 can, for example, be a jack plug or a hollow plug. These types of plug connector are known as such in various embodiments. One characteristic of this type of plug connector is that they can be rotated in a plugged-in condition in the assigned plug holder with the electrical contact being maintained. A further advantage is a design of a plug connector protected from pole reversal.

In the embodiment of the organic illumination device shown in FIG. 1 a rotational axis, namely the central axis of the plug device 4, is formed in the plane of the illuminating surface 5. Moreover, the rotational axis coincides with a symmetrical axis of the housing 1.

Figure 2:
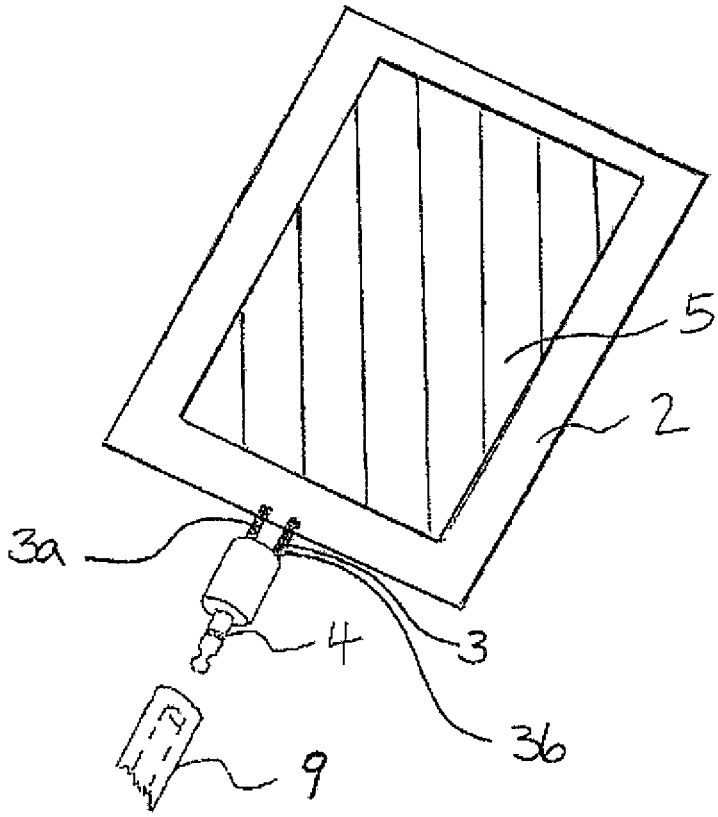
Figure 6:
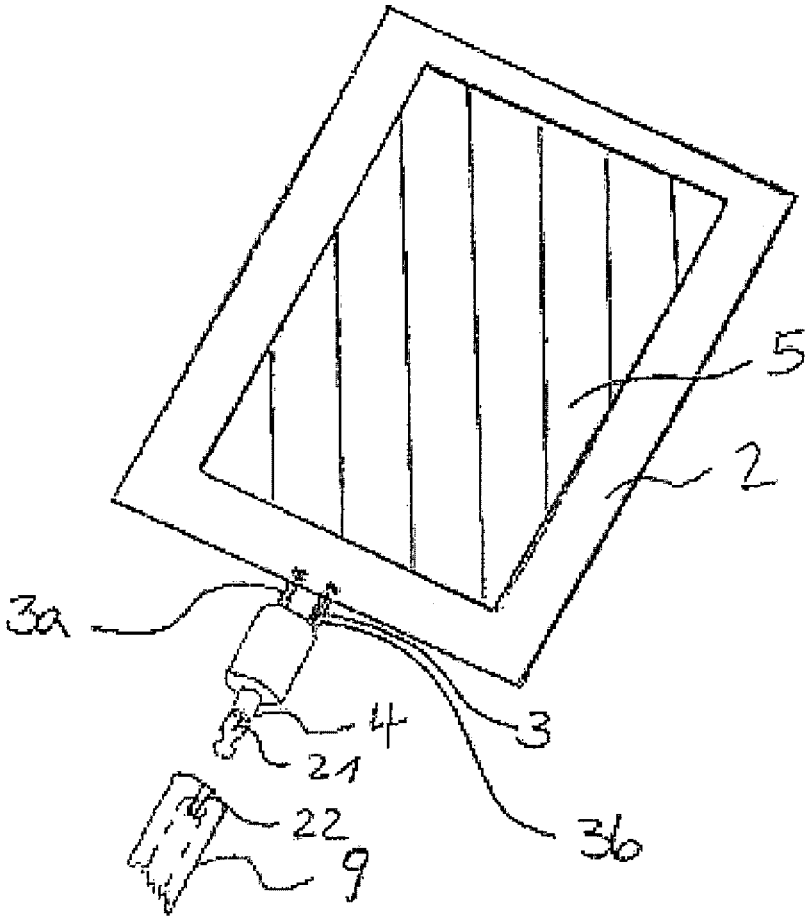
FIG. 6 a schematic diagram of an organic illumination device according to a further embodiment.

FIG. 2 shows a schematic diagram of an organic illumination device according to a further embodiment. The same reference numerals are used in FIG. 2 for the same features as those shown in FIG. 1. The illumination device is formed with a light source 2 which has a flat illuminating surface 5. There is a plug device 4 arranged on the light source 2 with which a plug holder 9 can be connected in a detachable manner. A connecting device 3, which is formed in the example shown with connecting contacts 3*a*, 3*b*, serves to connect electrical power provided via the plug device 4 to the electrodes of the organic light-emitting diodes of the light source 2. A simple latching or locking mechanism can be included in the device of FIG. 2 by providing friction between two surfaces, such as an outer surface of the plug device 4 and an inner surface of the plug holder 9. Alternatively, a latching or locking mechanism can be provided with one or more projections and one or more seatings. For example, FIG. 6, which uses the same reference numerals as FIG. 2, includes a projection 21 and a seating 22.

Figure 3:
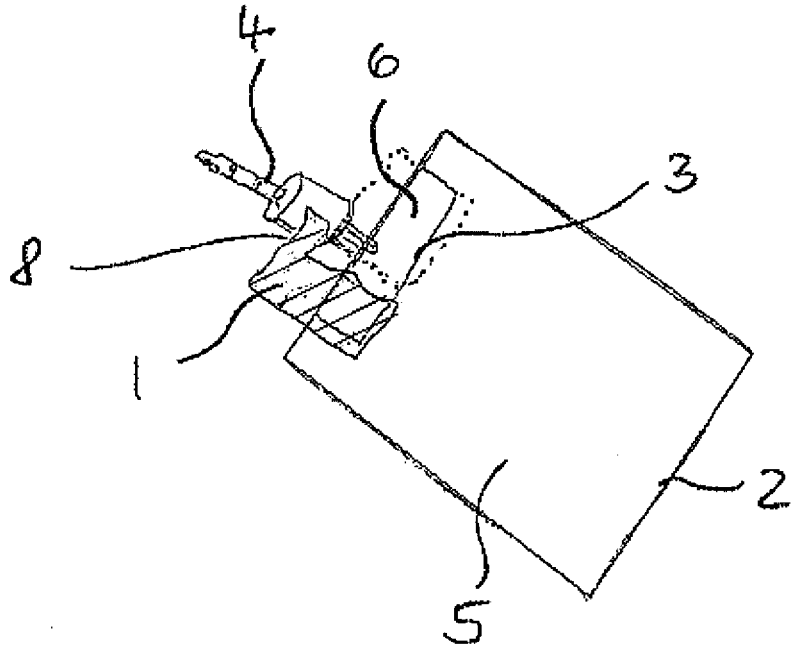

FIG. 3 shows a schematic diagram of an organic illumination device according to a further embodiment. The same reference numerals are used in FIG. 3 for the same features as those shown in FIGS. 1 and 2.

In contrast to the embodiment shown in FIG. 1, the plug device 4 is located at an angle of 90° the edge of the flat illuminating surface 5 at which the connecting device 3 is located. While the flat illuminating surface 5 for the embodiment in FIG. 1 can be swivelled around an axis at the edge or an adjacent axis, the flat illuminating surface 5 for the embodiment in FIG. 3 can be rotated around an axis which lies in the area of the flat illuminating surface 5 itself. As is the case for the embodiment in FIG. 1, the housing 1 provides a fixed and rigid connection of the plug device 4 to the light source 2 with the flat illuminating surface 5.

Figure 4:
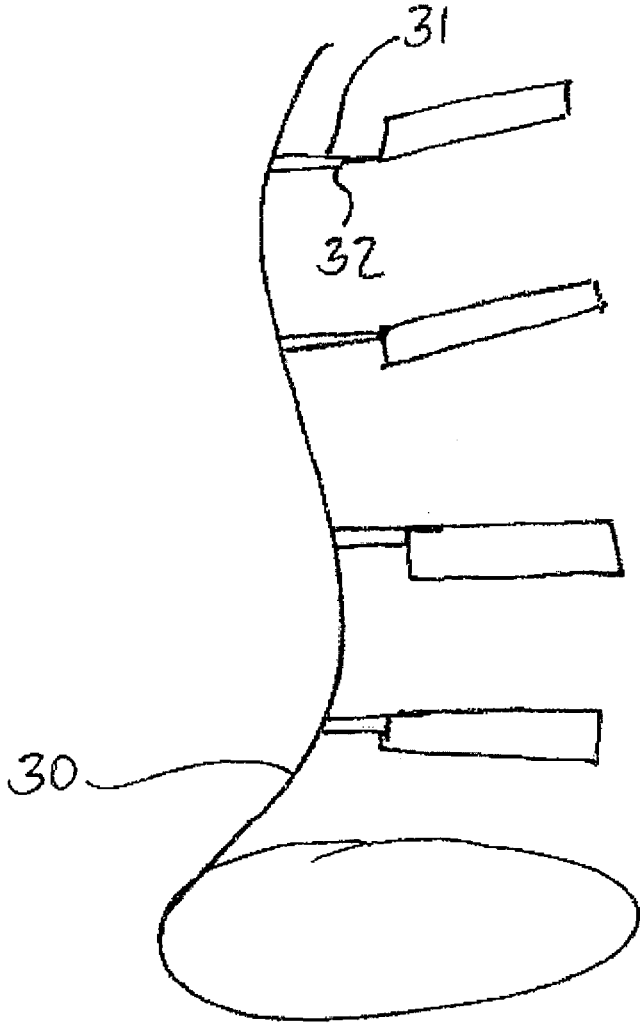

FIG. 4 shows a lighting device for which a number of arms 31 are formed on a basic body structure 30 which, at the ends, each have a plug holder 32 so that an organic illumination device can be respectively inserted into the plug holder 32 such that the organic illumination device can be rotated around a rotational axis. The organic illumination devices used can, for example, be the illuminants shown in FIGS. 1, 2 and 3.

The features the invention disclosed in the above description, the claims and the drawing can be of importance both individually and also in any desired combination for realising the invention in its various embodiments.

The invention claimed is:

1. An organic illumination device comprising:

a light source comprising a flat illuminating surface, wherein the flat illuminating surface comprises one or more organic light-emitting diodes;

a connecting device for applying electrical power to electrodes, which couples one or more organic light-emitting diodes; and a plug device which is electrically connected with the connecting device, and configured for a mount, wherein the mount is rotatable around a rotary axis in an assigned plug holder in such a way that the flat illuminating surface can be swiveled around the rotary axis in a plugged-in position of the plug device, wherein the plug device is configured such that the electrodes can be connected to a power supply protected from pole reversal.

2. The device according to claim 1, wherein the device comprises a housing in which the connecting device is at least partially accommodated, and from which the flat illuminating surface protrudes, and wherein the plug device is located at the housing.

3. The device according to claim 1, wherein the rotary axis is parallel to the flat illuminating surface.

4. The device according to claim 1, wherein the rotary axis is in the plane of the illuminating surface.

5. The device according to claim 2, wherein the housing comprises a slit-shaped mount in which the connecting device is at least partially accommodated.

6. The device according to claim 1, wherein the connecting device comprises a printed circuit board.

7. The device according to claim 2, wherein the flat illuminating surface and the plug device are rigidly connected with each other via the housing.

8. The device according to claim 2, wherein the housing comprises a stretched hollow body form.

9. The device according to claim 2, wherein the rotary axis is parallel to a symmetrical axis of the housing.

10. The device according to claim 1, wherein the flat illuminating surface is at least partially surrounded by a frame.

11. The device according to claim 1, wherein the plug device comprises a concentric contact.

12. The device according to claim 1, wherein the plug device comprises a latching or locking device on the plug side, which is configured to fix the flat illuminating surface in various rotated or swiveled positions.

13. The device according to claim 1, wherein the plug device and an assigned plug holder block swivelling of the flat illuminating surface in a first plugged-in position of the plug device, and allow swiveling of the flat illuminating surface in a second plugged-in position of the plug device, wherein the plug device is movable between the first and the second plugged-in position by shifting the assigned plug holder axially to the rotational axis.

14. A lighting device, wherein the lighting device comprises a basic structure, wherein the basic structure comprises one or more plug holders, and wherein at least one organic illumination device is plugged in and rotatable on one or more of the plug holders, wherein the at least one organic illumination device comprises:

a light source comprising a flat illuminating surface, wherein the flat illuminating surface comprises one or more organic light-emitting diodes;

a connecting device for applying electrical power to electrodes, which couples one or more organic light-emitting diodes; and a plug device which is electrically connected with the connecting device, and is configured for a mount, wherein the mount is rotatable around a rotary axis in an assigned plug holder in such a way that the flat illuminating surface can be swiveled around the rotary axis in a plugged-in position of the plug device, wherein the plug device is configured such that the electrodes can be connected to a power supply protected from pole reversal.

* * * * *